US011019889B2

(12) United States Patent
Nicolas et al.

(10) Patent No.: US 11,019,889 B2
(45) Date of Patent: Jun. 1, 2021

(54) REMOVABLE BRACELET FOR A WATCH OR EQUIVALENT AND DEVICE FOR ATTACHING THE SAME

(71) Applicant: The Swatch Group Research and Development Ltd, Marin (CH)

(72) Inventors: Cedric Nicolas, Neuchatel (CH); Dominique Lechot, Les Reussilles (CH); Nicolas Francois, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 318 days.

(21) Appl. No.: 16/150,683

(22) Filed: Oct. 3, 2018

(65) Prior Publication Data

US 2019/0125041 A1 May 2, 2019

(30) Foreign Application Priority Data

Nov. 2, 2017 (EP) ..... 17199712

(51) Int. Cl.
*A44C 5/14* (2006.01)
*G04B 37/14* (2006.01)

(52) U.S. Cl.
CPC ..... *A44C 5/14* (2013.01); *G04B 37/1486* (2013.01)

(58) Field of Classification Search
CPC ..... A44C 5/14; A44C 5/147; G04B 37/1486; G04B 37/1493
USPC ..... 368/282
See application file for complete search history.

(56) References Cited

U.S. PATENT DOCUMENTS

| | | | | |
|---|---|---|---|---|
| 4,396,296 | A | 8/1983 | Stodden | |
| 6,014,793 | A | 1/2000 | Howald | |
| 7,380,979 | B2 * | 6/2008 | Hiranuma | A44C 5/14 368/282 |
| 8,978,942 | B2 * | 3/2015 | Bell | A44B 11/24 224/177 |
| 9,314,071 | B2 * | 4/2016 | Rivera | A44C 5/14 |
| 10,359,739 | B2 * | 7/2019 | Vuille | G04B 37/1486 |

FOREIGN PATENT DOCUMENTS

| | | | |
|---|---|---|---|
| CH | 694 393 | A5 | 12/2004 |
| FR | 2 742 638 | A1 | 6/1997 |
| FR | 2 849 355 | A1 | 7/2004 |
| WO | WO 2013/140080 | A1 | 9/2013 |

OTHER PUBLICATIONS

European Search Report dated Apr. 30, 2018 in European Application 17199712.5 filed on Nov. 2, 2017 (with English Translation of Categories of Cited Documents).

* cited by examiner

*Primary Examiner* — Edwin A. Leon
(74) *Attorney, Agent, or Firm* — Oblon, McClelland, Maier & Neustadt, L.L.P.

(57) ABSTRACT

A device for attaching an end of a bracelet to an object, including a support plate, a control member, two pins slidably mounted on the same axis, called the sliding axis, wherein the control member is mounted to move in translation on an arbor, called the translation arbor, which is substantially perpendicular to the support plate, and wherein the control member is offset with respect to the sliding axis of the pins and connected to the latter by connecting elements able to transform the translational movement of the control member into a sliding movement of the pins when the control member is actuated.

23 Claims, 3 Drawing Sheets

REMOVABLE BRACELET FOR A WATCH OR EQUIVALENT AND DEVICE FOR ATTACHING THE SAME

This application claims priority from European Patent Application No. 17199712.5 filed on Nov. 2, 2017; the entire disclosure of which is incorporated herein by reference.

FIELD OF THE INVENTION

The present invention relates to the field of removable bracelets or straps which allow an object, such as a watch, to be secured to the wrist.

BACKGROUND OF THE INVENTION

Bracelets and especially watch bracelets are connecting elements made of different types of materials—leather, plastic, metal, sometimes even fabric—which allow an object such as a watch, but also more generally a piece of jewellery of any shape, to be secured to the wrist of the person who wishes to wear it. These bracelets are fitted to the person's wrist and are usually directly attached to the watch case horns by means of small metal rods called bars which are fixed inside a suitable housing provided in the horns.

In the case of damage or simply for aesthetic reasons, the user may have to change the bracelet several times over the life of his watch. To this end, there are attachment devices which make it possible to change bracelets more or less easily without the use of specific tools. However, although no specific tools are required to change the bracelet and this can therefore be done by the user, it may be difficult to handle the attachment device, and/or the device may have control members that are not only visible from outside the bracelet but are also liable to catch or snag. Thus, for example, European Patent No EP2766587 discloses an attachment device that has these drawbacks. The device includes two spring lugs, one of which is provided with a finger projecting outside the bracelet, the movement of the finger causing the lug to retract into the bar.

SUMMARY OF THE INVENTION

To overcome the aforecited drawbacks, it is a main object of the invention to propose a new attachment device which is easy for the user to handle and which can be arranged invisibly inside the bracelet. It is also an object of the present invention to propose an attachment device which is robust, as attachment bars are generally relatively fragile.

To this end, the present invention proposes an attachment device provided with a control member intended, after insertion inside the bracelet, to move vertically with respect to the bracelet. In this configuration, the attachment device and more particularly the control member, can be entirely embedded in the bracelet and operated by using the flexibility of the material that covers the control member.

The control member also has the feature of being offset with respect to the sliding axis of two pins which form the attachment bar, which increases robustness and guiding precision compared to a configuration wherein the control member is positioned on the sliding axis of the pins.

As the control member is offset with respect to the sliding axis of the pins, the attachment device is provided with connecting elements between the control member and the attachment bar which transform the vertical movement of translation of the control member into a lateral sliding motion of the bar between a position of engagement and a retracted position wherein the bar is detached from the object to which it is fixed.

Advantageously, the connecting elements comprise two arms articulated about an arbor arranged at a proximal end of said arms, the two pins being respectively connected to the distal end of the articulated arms via connecting rods. The control member and the articulated arms are configured to produce a movement apart of the arms around the arbor resulting in the moving together of their distal ends, which are connected to the two pins, thereby placing said pins in a retracted position.

In other words, the connecting elements successively comprise between the control member and the pins:

- two arms articulated at one end about a vertical arbor, called the pivot arbor, the arms being arranged around the control member symmetrically with respect to a line connecting said pivot arbor and the translation arbor of the control member,
- two connecting rods each pivoting on the other end of said arms and respectively integral with the pins.

In use, the pivoting of the arms following actuation of the control member causes a lateral movement of the connecting rods and thereby a movement of the pins.

Other advantages will appear from the features set out in the claims, and from the detailed description of the invention illustrated hereinafter with reference to the annexed drawings, provided as non-limiting examples.

DETAILED DESCRIPTION OF THE INVENTION

Figure 1:
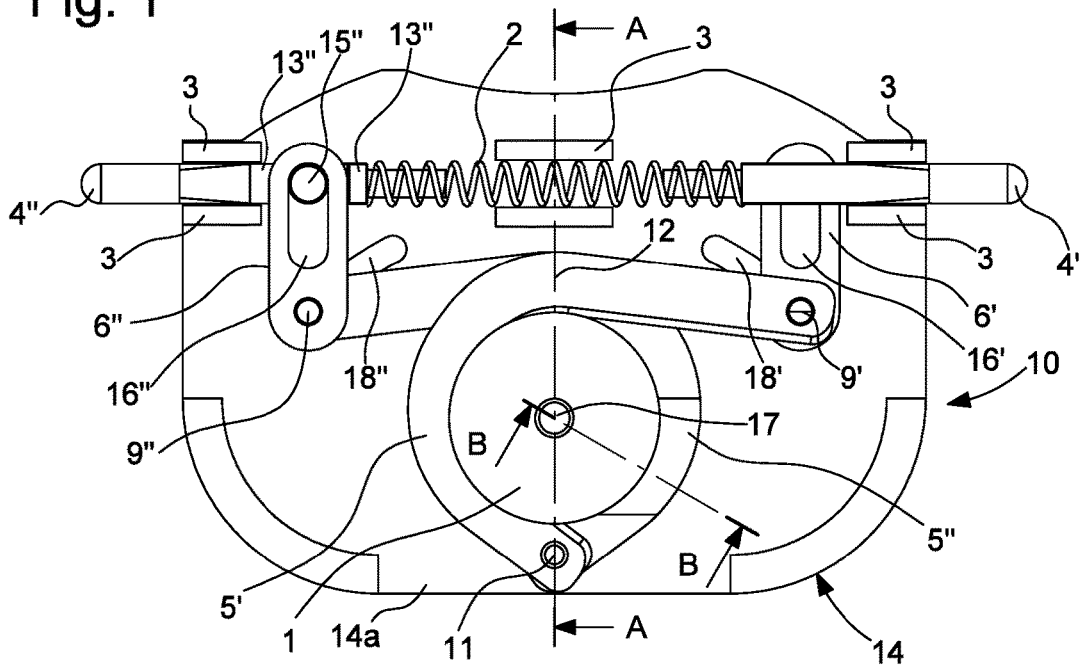
FIG. 1 represents a plan view of the attachment device according to the invention in a position of engagement.

The attachment device 10 according to the invention represented in FIGS. 1 to 5 is intended to be invisibly arranged at the end of a bracelet, such as a watch or jewellery bracelet. It is more particularly illustrated in FIG. 6 in the context of attachment of a bracelet 100 to a watch case 200 provided with horns 21, 22, comprising blind or through holes 23, 24 for housing the bar of the attachment device. Conversely, in another embodiment of the invention, it is possible to envisage a lug with pivots in which case the bar will have holes at its ends for receiving the pivots.

Figure 4:
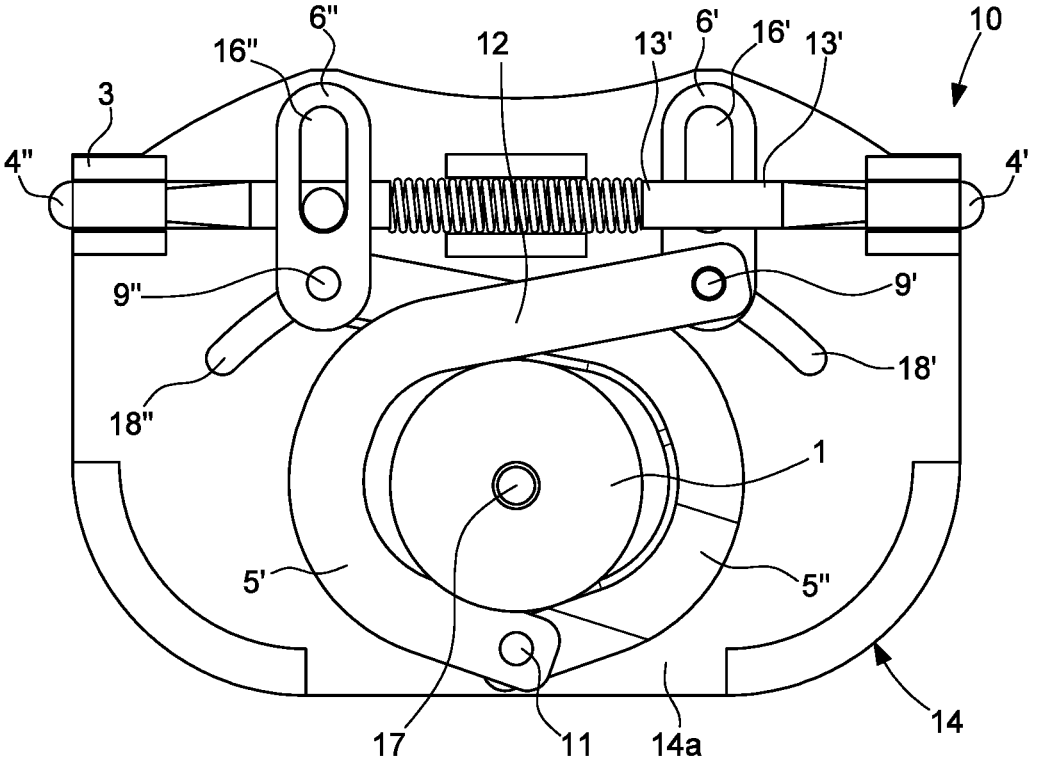
FIG. 4 represents the device of FIG. 1 in a retracted position.

Attachment device 10 according to the invention can adopt two positions represented in FIGS. 1 and 4 consisting respectively of a rest position, which can also be described as the position of engagement, corresponding to a position in which the bracelet is attached to the watch case, and a retracted position in which the bracelet is detached from the watch case.

Figure 2:
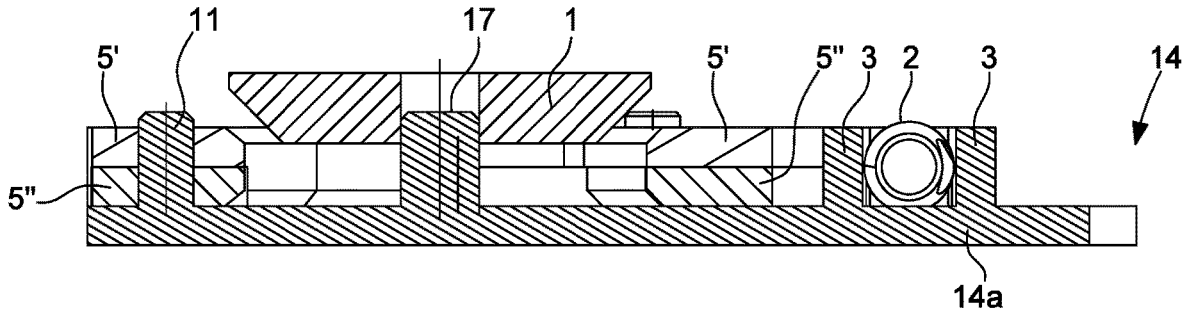
FIG. 2 is a cross-section along axis AA of FIG. 1.

Attachment device 10 according to the invention includes a support plate 14 on which is mounted the mechanism for switching from one position to the other. This plate 14 is formed of a base 14*a* surmounted by several arbors 11, 17 on which the elements of the mechanism are movably mounted (FIG. 2). Plate 14 is thus provided with an arbor 17 perpendicular to the plane of base 14*a* on which is mounted to move in translation a control member, namely a push button 1, which makes it possible to actuate the mechanism and more precisely to move in translation two pins 4', 4", serving as a retractable bar.

These two pins 4', 4" are arranged on the same axis on which they slide in translation (FIG. 1). They are connected by a spring 2 holding pins 4', 4" in the rest position in the absence of contact on the push button by a user. The translation of pins 4', 4' along their axis is ensured by guide walls 3 integral with support plate 14 and arranged along the axis on either side of each pin 4' 4", and spring 2 with, in the illustrated example, three pairs of walls 3 respectively arranged at the ends and at the centre of the plate along said axis.

According to the invention, push button 1 is not arranged on the axis of the pins but offset with respect to said axis. Hence, the movement of the two pins 4', 4", is linked to the movement of push button 1 by means of two arms 5', 5" respectively articulated on connecting rods 6', 6" which are in turn secured to pins 4', 4" by means of fingers 15', 15" protruding onto each pin 4', 4".

Figure 3:
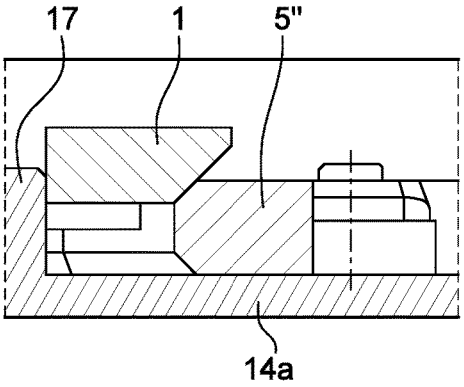
FIG. 3 is a cross-section along axis BB of FIG. 1.

The two arms 5', 5" are mounted to pivot on a vertical arbor 11 formed in support plate 14 and visible, among others, in FIGS. 1 and 2. Arms 5', 5" are arranged symmetrically with respect to the line formed by arbors 11 and 17 aligned in a direction perpendicular to the axis of pins 4', 4". Arms 5', 5" overlap on arbor 11 with respectively one arm 5" in a lower position and one arm 5' in an upper position with respect to the plane of the support plate. They respectively pass around control member 1 before crossing each other at a point 12, which is also aligned on the line formed by arbors 11 and 17 and diametrically opposite to arbor 11. As detailed in FIG. 5, each arm 5', 5" includes a first curved portion, referenced a, which substantially follows the shape of push button 1, and extends substantially between arbor 11 and crossing point 12. This first curved portion a is followed by a second rectilinear portion, referenced b, extending substantially from crossing point 12 up to pins 9', 9" ensuring the rotational connection between arms 5', 5" and connecting rods 6', 6". In the illustrated example, the arm 5" in the lower position passes around to the right of push button 1 and then extends to the left to control the movement of the corresponding pin 4". Through symmetry, arm 5' in the upper position passes around to the left of push button 1 and extends to the right to control the movement of the corresponding pin 4'. In the illustrated example, on the inner sides of their curved portion, the arms have an inclined wall on which the lateral sides of the tapered push button are intended to slide (FIG. 3). Alternatively, the inclined wall could be replaced by a rounded surface to reduce the friction surface. Further, each arm 5', 5" includes an extra thickness, referenced c and visible in FIG. 5, which is arranged on its curved portion a and takes up the difference in height in areas where the arms are not superposed and hence ensures a symmetrical movement of the two arms when the push button is actuated. More precisely, the arm 5" in the upper position on arbor 11 includes an extra thickness 5"*c* arranged in the opposite direction to support plate 14 whereas arm 5' in the upper position includes an extra thickness 5'*c* extending in the direction of support plate 14. These extra thicknesses are arranged so as not to hinder the movement of the arms during pivoting.

Arms 5', 5" are attached to connecting rods 6', 6" via pegs 9', 9" allowing a relative rotational movement between arms 5', 5" and connecting rods 6', 6". To this end, pegs 9', 9" slide inside holes 18', 18" arranged in support plate 14 in arcs centred on arbor 11.

Connecting rods 6', 6" are flat parts, of oblong shape in the illustrated example, and of substantially equal thickness to that of the arms. A hole 16', 16", also of oblong shape, is provided in each connecting rod 6', 6". Finger 15', 15", secured to pins 4', 4", is guided in this hole. During their movement, connecting rods 6', 6" are maintained perpendicular to the axis of pins 4', 4" by means of rigid walls 13', 13" provided in pins 4', 4" and between which connecting rods 6', 6" slide.

As shown in FIG. 1, pins 4', 4" and connecting rods 6', 6" are arranged differently depending on the position of the arm 5', 5" to which they are connected. For arm 5" in the lower position, connecting rod 6" is positioned above the arm. More precisely, arm 5" is positioned between hole 18" and connecting rod 6" with finger 15" of pin 4" turned to the side opposite to plate 14. Conversely, for arm 5' in the upper position, connecting rod 6' is positioned underneath the arm, i.e. between hole 18' and arm 5' with finger 15' of pin 4' turned towards support plate 14.

Figure 5:
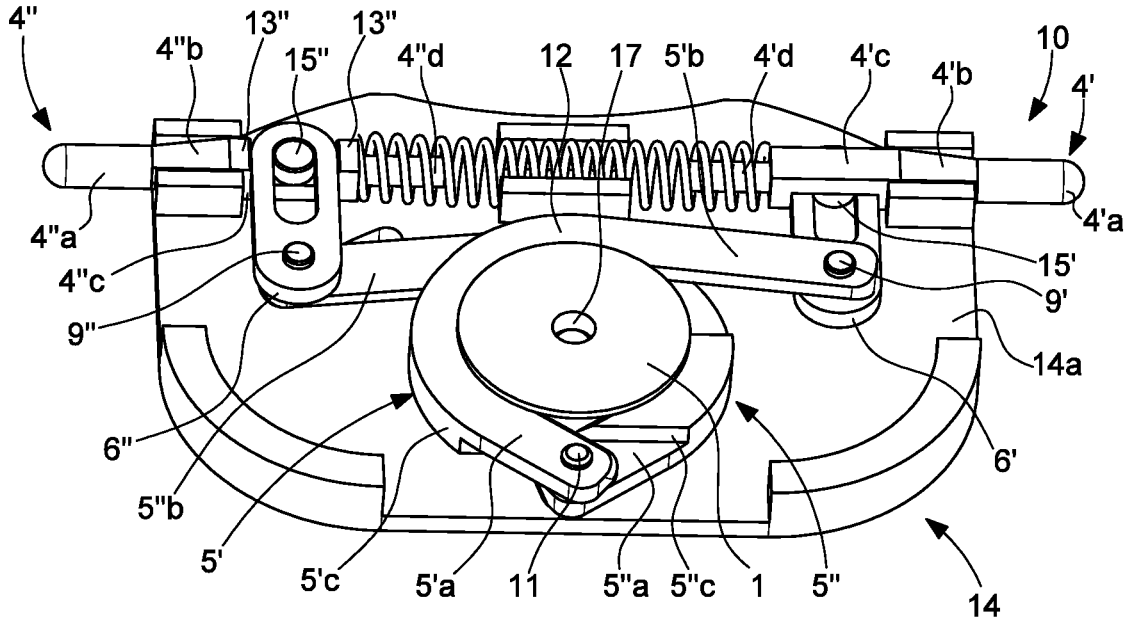
FIG. 5 is a perspective view of the attachment device according to the invention in a position of engagement.
Figure 6:
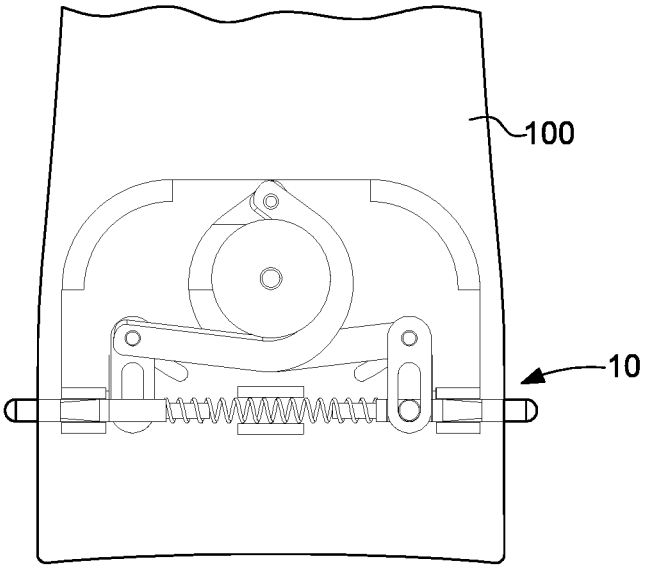
FIG. 6 is a perspective view of a bracelet and of the corresponding watch case with the attachment device according to the invention seen transparently through the bracelet.
Figure 6:
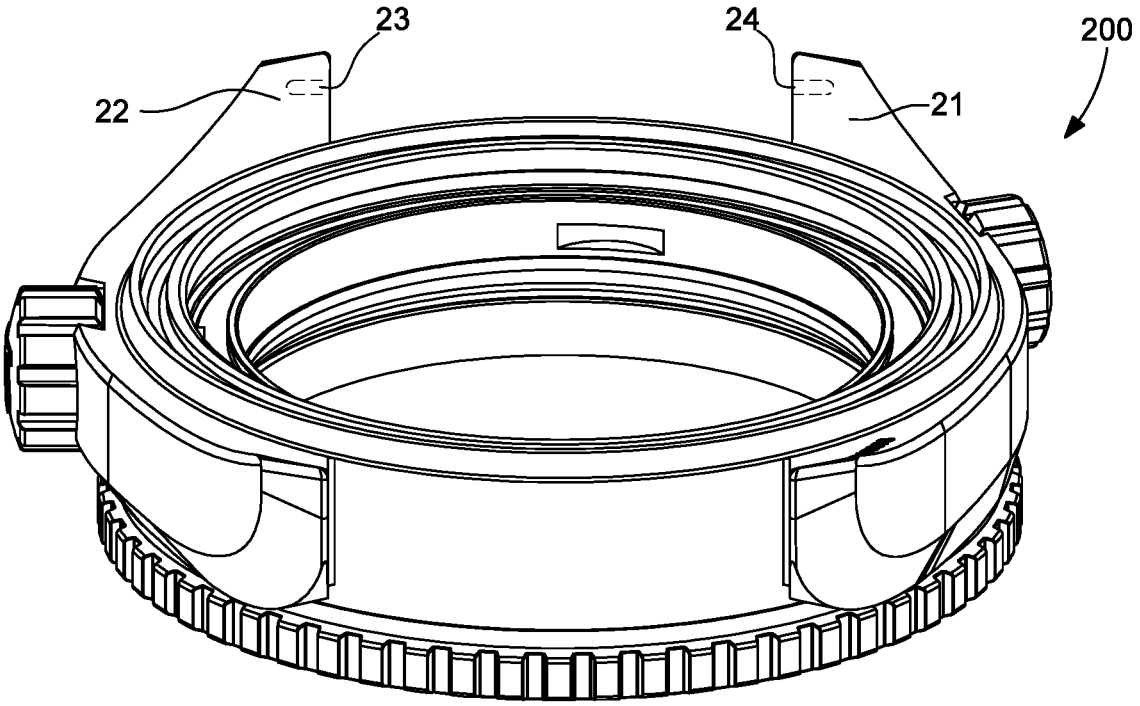

As detailed in the example embodiment illustrated in FIG. 5, each pin 4', 4" includes a cylindrical end 4'*a*, 4"*a* intended to be housed inside holes provided in the watch case horns. After the cylindrical portion, pin 4', 4" includes a tapered portion 4'*b*, 4"*b* flaring towards a U-shaped portion 4'*c*, 4"*c* inside which slides the corresponding connecting rod 6', 6" with the U-shaped walls 13', 13" of the U performing the function of guiding the connecting rod. This portion includes finger 15', 15" standing in the hollowed portion of the U. After the U-shaped portion, pin 4', 4" includes a second cylindrical portion 4'*d*, 4"*d* around which spring 2 is wound. The diameter of this portion is smaller than the height of wall 13, 13", so that the latter forms a shoulder on which spring 2 rests. It is evident that other geometries of pins 4', 4" could be envisaged provided that they comprise an end portion able to cooperate with the holes in the bars arranged in the lugs of a watch case. In a variant, pins 4', 4" could even made in one piece comprising a median portion forming a spring.

Ideally, the pins are made of metal with an anti-friction coating at the ends intended to be housed inside the watch case to prevent scratches inside the horns. This coating may be made, in particular, of PTFE or polyurethane charged with a perfluopolyether (PFPE) oil.

As regards push button 1, this has a circular bearing surface mounted on a tapered base with a recess at its centre for the passage of arbor 17. The contact surfaces between push-button 1 and arms 5', 5" are arranged to slide easily one over the other. It may be useful to improve sliding through a suitable choice of materials, by using either an intrinsically slippery material such as a fluorinated polymer, or a coating of such a polymer. Again, to facilitate the sliding of the push button, the latter has a conical shape with a wall inclined at an angle preferably comprised between 30 and 60°, more preferably between 40 and 50°, with respect to arbor 17. The slope of the push button is chosen such that the travel of the button is comprised between 0.3 and 0.8 mm.

Advantageously, the push button can be mounted on elastic means such as a spring or a strip (not represented) which assist, together with spring 2 positioned between the pins, in returning the push button to the high position when the latter is released. These elastic means can be used as an audible foolproof device. To this end, the elastic means may include a flexible metal strip which stretches when the control member is pressed and relaxes when it goes beyond a certain travel, the relaxing of the strip producing a distinctive click which has the further advantage of indicating to the user that the pins, and hence the bracelet, are properly attached to the watch case.

The operation of the device is illustrated by means of FIGS. 1 and 4. When button 1 is pressed (FIG. 4), the inclined lateral surfaces of button 1 press on the corresponding surfaces of arms 5', 5". As this happens, arms 5' 5" move apart between arbor 11 and crossing point 12. This movement apart causes a movement of pegs 9', 9" at the end of arms 5', 5" in guide holes 18', 18". This rotational movement causes a lateral and vertical movement of translation of connecting rods 6', 6". The vertical translational movement of connecting rods 6', 6" is taken up by the sliding of said rods between walls 13', 13" and by the sliding of finger 15', 15" in the corresponding hole 16', 16". However, the lateral movement of connecting rods 6', 6" causes a corresponding movement of pins 4', 4" and, consequently, the retraction of pins 4', 4". When the pressure on button 1 is released, spring 2 pushes pins 4', 4" back into the rest position, pushing back arms 5', 5" which in turn push button 1 back into the rest position, possibly aided by the aforementioned additional elastic means.

According to the invention, support plate 14 surmounted by the mechanism is invisibly arranged inside the bracelet. The attachment device can thus be placed inside a leather, woven or embroidered textile or plastic bracelet with a marker showing the user where to press on the button. It is also possible to envisage placing the attachment device according to the invention on a metal or ceramic bracelet in a plastic portion overmoulded onto a bracelet link. In each case, it is the flexibility of the bracelet material that makes it possible to actuate the push button embedded in the bracelet. Preferably, the bearing surface of the control member is positioned between 0.2 and 0.7 mm under the surface of the bracelet. It can be placed under the lower side of the bracelet, i.e. the side intended to be placed facing the wrist, or conversely under the external face of the bracelet.

Finally, it will be specified that support plate 14 provided with the mechanism can be confined inside a case pierced with an opening for the passage of a push button. To this end, the plate can be delimited at certain places by rims 17 whose height is substantially equal to that of the superposed arms, with a closing lid (not represented) resting on said rims.

What is claimed is:

1. A device for attaching an end of a bracelet to an object, comprising;

a support plate formed of a base defining a plane, a control member, two pins slidably mounted in the plane of the support plate on a same sliding axis, said pins being able, after actuation of the control member to move between a position of engagement in which the pins are secured to the object, and a retracted position in which the pins are detached from the object, and elastic means connecting the two pins and maintaining said pins in a position of engagement in an absence of actuation of the control member, wherein the control member is mounted to move in translation on an arbor, called a translation arbor, which is substantially perpendicular to the plane of the support plate, and wherein the control member is offset with respect to the sliding axis of the pins and connected to the latter by connecting elements able to transform a translational movement of the control member into a sliding movement of the pins when the control member is actuated, and wherein the connecting elements successively include between the control member and the pins:

two arms articulated at one end about an arbor, called a pivot arbor, the arms being arranged around the control member symmetrically with respect to a line connecting said pivot arbor and the translation arbor of the control member, said line being perpendicular to the sliding axis of the pins, and two connecting rods each mounted to pivot via pegs on the other end of said arms.

2. The device according to claim 1, wherein the two arms overlap on the pivot arbor with respectively one arm in a lower position and one arm in an upper position with respect to the plane of the support plate, said arms extending respectively on each side of the control member before crossing at a crossing point aligned on said line and diametrically opposite to the pivot arbor.

3. The device according to claim 2, wherein each arm includes a first curved portion substantially following the shape of the control member and extending substantially between the pivot arbor and the crossing point, followed by a second, rectilinear portion extending substantially from the crossing point to the pegs ensuring the connection between the arms and the connecting rods.

4. The device according to claim 3, wherein each arm includes on one part of its first curved portion an extra thickness of substantially equal thickness to the thickness of the other arm, the arm in the upper position having an extra thickness extending towards the support plate and the arm in the lower position having an extra thickness extending from the side opposite the support plate.

5. The device according to claim 1, wherein the control member forms a push button with a tapered lateral surface intended to cooperate with corresponding surfaces arranged on inner sides of the arms.

6. The device according to claim 1, wherein arc-shaped openings centred on the pivot arbor are made in the support plate, the pegs connecting the arms to the connecting rods being driven inside said openings and arranged to slide inside said openings to transform a pivoting movement of the arms into a sliding movement of the pins.

7. The device according to claim 1, wherein a hole is provided in each connecting rod, a finger respectively secured to each pin being driven inside said hole.

8. The device according to claim 1, wherein each pin includes two walls perpendicular to the sliding axis between which each connecting rod is guided.

9. The device according to claim 7, wherein, for the arm in the upper position, the connecting rod is positioned between the opening and the arm with the finger of the pin turned towards the support plate and wherein for the arm in the lower position, the arm is positioned between the opening and the connecting rod with the finger of the pin turned to the side opposite the plate.

10. The device according to claim 1, wherein the support plate includes guide walls arranged along the sliding axis of the pins on either side of each pin and elastic means.

11. The device according to claim 7, wherein each pin includes a first cylindrical portion intended to be engaged in the object, a second conical portion flaring towards a third portion in a U-shape forming a housing delimited by the walls and inside which stands the finger, a fourth cylindrical portion around which the elastic means are wound, supported on one of the walls of the third portion.

12. The device according to claim 1, wherein each connecting rod forms a flat part of substantially equal thickness to the thickness of the arms.

13. The device according to claim 1, wherein the control member is mounted on additional elastic means ensuring, together with the elastic means arranged between the pins, the return of the control member following actuation of said control member.

14. The device according to claim 13, wherein the additional elastic means include a metal strip fixed to the control member which extends when the control member is actuated and relaxes when the control member goes beyond a certain travel, relaxation of the metal strip causing a characteristic click sound which makes it possible to detect that the pins are properly secured in the object.

15. The device according to claim 11, wherein the first cylindrical portion of the pins is coated with an anti-friction coating.

16. The device according to claim 1, wherein the travel of the control member is comprised between 0.3 and 0.8 mm.

17. A bracelet comprising:

an attachment device for attaching an end of the bracelet to an object, the attachment device comprising;

a support plate formed of a base defining a plane, a control member, two pins slidably mounted in the plane of the support plate on a same sliding axis, said pins being able, after actuation of the control member to move between a position of engagement in which the pins are secured to the object, and a retracted position in which the pins are detached from the object, and elastic means connecting the two pins and maintaining said pins in a position of engagement in an absence of actuation of the control member, wherein the control member is mounted to move in translation on an arbor, called a translation arbor, which is substantially perpendicular to the plane of the support plate, and wherein the control member is offset with respect to the sliding axis of the pins and connected to the latter by connecting elements able to transform a translational movement of the control member into a sliding movement of the pins when the control member is actuated, and wherein the connecting elements successively include between the control member and the pins:

two arms articulated at one end about an arbor, called a pivot arbor, the arms being arranged around the control member symmetrically with respect to a line connecting said pivot arbor and the translation arbor of the control member, said line being perpendicular to the sliding axis of the pins, and two connecting rods each mounted to pivot via pegs on the other end of said arms.

18. The bracelet according to claim 17, wherein the attachment device is embedded in the bracelet.

19. The bracelet according to claim 17, wherein the bracelet is made of metal or ceramic with an overmoulded plastic portion comprising the attachment device made of leather, of woven or embroidered textile or of plastic material.

20. The bracelet according to claim 17, wherein the position of the control member is indicated by a marking on the surface of the bracelet.

21. The bracelet according to claim 17, wherein the bearing surface of the control member is positioned between 0.2 and 0.7 mm under the surface of the bracelet.

22. A watch or piece of jewellery including the bracelet according to claim 17.

23. The device according to claim 1, wherein the elastic means connecting the two pins is a spring.

* * * * *